US012000078B2

(12) United States Patent
Mizer et al.

(10) Patent No.: US 12,000,078 B2
(45) Date of Patent: Jun. 4, 2024

(54) LAUNDRY TREATMENT APPARATUS HAVING MULTIPLE TREATMENT COMPOSITION RECEPTACLES

(71) Applicant: The Procter & Gamble Company, Cincinnati, OH (US)

(72) Inventors: Scott Eugene Mizer, Loveland, OH (US); Corey Elizabeth DeRossett, Highland Heights, KY (US); Carlos Amador Zamarreno, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 262 days.

(21) Appl. No.: 17/507,290

(22) Filed: Oct. 21, 2021

(65) Prior Publication Data

US 2022/0127775 A1 Apr. 28, 2022

(30) Foreign Application Priority Data

Oct. 23, 2020 (EP) ..... 20203500

(51) Int. Cl.
*D06F 39/02* (2006.01)
*D06F 25/00* (2006.01)

(52) U.S. Cl.
CPC ..... *D06F 39/022* (2013.01); *D06F 25/00* (2013.01)

(58) Field of Classification Search
CPC ..... D06F 39/022
See application file for complete search history.

(56) References Cited

U.S. PATENT DOCUMENTS

| | | | |
|---|---|---|---|
| 4,110,075 | A | 8/1978 | Graf |
| 4,188,807 | A | 2/1980 | Brodzina et al. |
| 5,588,313 | A | 12/1996 | Hildebrand |
| 9,587,346 | B2 | 3/2017 | Greger et al. |
| 2010/0071777 | A1 | 3/2010 | Smith et al. |
| 2014/0190220 | A1 | 7/2014 | Lee et al. |
| 2021/0032793 | A1 | 2/2021 | Kessler et al. |

FOREIGN PATENT DOCUMENTS

| | | | |
|---|---|---|---|
| CN | 110528237 | A | 12/2019 |
| EP | 1213384 | A2 | 6/2002 |
| KR | 101036038 | B1 | 5/2011 |

OTHER PUBLICATIONS

PCT Search Report and Written Opinion for PCT/US2021/071923 dated Jan. 26, 2022, 14 pages.
Extended EP Search Report and Search Opinion for 20203500.2 dated Apr. 6, 2021, 12 pages.

*Primary Examiner* — Jason Y Ko
(74) *Attorney, Agent, or Firm* — George H. Leal; Gary Joseph Foose

(57) ABSTRACT

A laundry treatment apparatus including a base, a tub, and a drum rotatable relative to the tub about an axis of rotation that is within 20 degrees of horizontal. The axis of rotation is in a sagittal plane of the drum. The apparatus further includes a detergent container receptacle and a fabric softener container receptacle. The detergent container receptacle is further away from the sagittal plane than the fabric softener container receptacle. The laundry treatment apparatus optionally includes a heater that is optionally elevationally higher than the axis of rotation and the sagittal plane is optionally between the detergent container receptacle and at least a portion of the heater.

20 Claims, 6 Drawing Sheets

LAUNDRY TREATMENT APPARATUS HAVING MULTIPLE TREATMENT COMPOSITION RECEPTACLES

FIELD OF THE INVENTION

The present invention relates to an automatic laundry treatment apparatus.

BACKGROUND OF THE INVENTION

The number of urban households continues to increase. Within a household, there are a variety of tasks that must be accomplished. One of those tasks is managing the laundry. Many households prefer to do their own laundry out of convenience, lack of trust of other service providers, or to save money. For many households, the optimum solution for budgeting their time and treasure is to do their laundry within the confines of their household. For many urban households, space is at a premium. Thus, there is demand for household appliances, such as laundry treatment apparatuses, that use space efficiently and perform the task at hand in an acceptable manner.

Most laundry treatment apparatuses are operated by the user placing laundry in the apparatus, dispensing laundry detergent to drum of the apparatus, closing a door to the apparatus, and initiating a laundry treatment cycle. In some apparatuses, laundry treatment compositions are dispensed into a drawer of the apparatus and those compositions are flushed from the drawer and transported to the tub of the laundry treatment apparatus. In these two approaches, the user must not only accommodate the space that the laundry treatment apparatus takes up, but must also accommodate the space required for storing containers of the laundry treatment compositions. Within urban households, there is often a shortage of storage space and the storage space may not be conveniently located near the laundry treatment apparatus. These encumbrances can make the doing laundry unpleasurable.

For laundry treatment apparatuses that are enabled to deliver multiple laundry treatment compositions, the rates at which different laundry treatment compositions are consumed can vary. This can make it difficult for the persons responsible for maintaining a suitable, yet minimal, inventory of various laundry treatment compositions. For example, detergent may be consumed at a rate that differs from the rate at which fabric softener is consumed.

There are some laundry treatment apparatuses that provide for onboard containers of laundry treatment compositions and the containers contain sufficient volumes of laundry treatment compositions to do multiple loads of laundry. In such laundry treatment apparatuses, the onboard containers are provided above or below the drum. However, such arrangements tend to take up significant amount of space within the laundry treatment apparatus and increase the amount of space required for the laundry treatment apparatus. Further, such arrangements may only provide for equal volumes of laundry treatment compositions to be stored onboard the laundry treatment apparatus.

With these limitations in mind, there is a continuing unaddressed need for laundry treatment apparatuses that have the capacity to compactly store multiple laundry treatment compositions onboard that are designed with the understanding of the rates at which laundry treatment compositions are consumed.

SUMMARY OF THE INVENTION

A laundry treatment apparatus comprising: a base upon which the laundry treatment apparatus rests; a tub defining a fluid containment envelope, wherein the tub is above the base; a drum positioned within the tub and rotatable relative to the tub about an axis of rotation that is within about 20 degrees of horizontal, wherein the axis of rotation is in a sagittal plane of the drum, wherein the sagittal plane is orthogonal to the base; a detergent container receptacle; a fabric softener container receptacle; wherein the detergent container receptacle is further away from the sagittal plane than the fabric softener container receptacle; a heater, wherein the sagittal plane is between the detergent container receptacle and at least a portion of the heater, wherein the heater is engaged with a heated air conveyance and the heated air conveyance is in fluid communication with the drum, wherein optionally the heater is elevationally higher than the axis of rotation when the laundry treatment apparatus is in operable position.

A laundry treatment apparatus comprising: an apparatus base upon which the laundry treatment apparatus rests; a tub defining a fluid containment envelope, wherein the tub is above the apparatus base; a drum positioned within the tub and rotatable relative to the tub about an axis of rotation that is within about 20 degrees of horizontal relative to the base, wherein the axis of rotation is in a sagittal plane of the drum, wherein the sagittal plane is orthogonal to the apparatus base; a detergent container receptacle; a fabric softener container receptacle; a perfume container receptacle; wherein the detergent container receptacle is further away from the sagittal plane than the fabric softener container receptacle and the fabric softener container receptacle is further away from the sagittal plane than the perfume container receptacle; wherein the detergent container receptacle, the fabric softener container receptacle, and the perfume container receptacle are elevationally higher than the axis of rotation when the laundry treatment apparatus is in operable position.

DETAILED DESCRIPTION OF THE INVENTION

Figure 1:
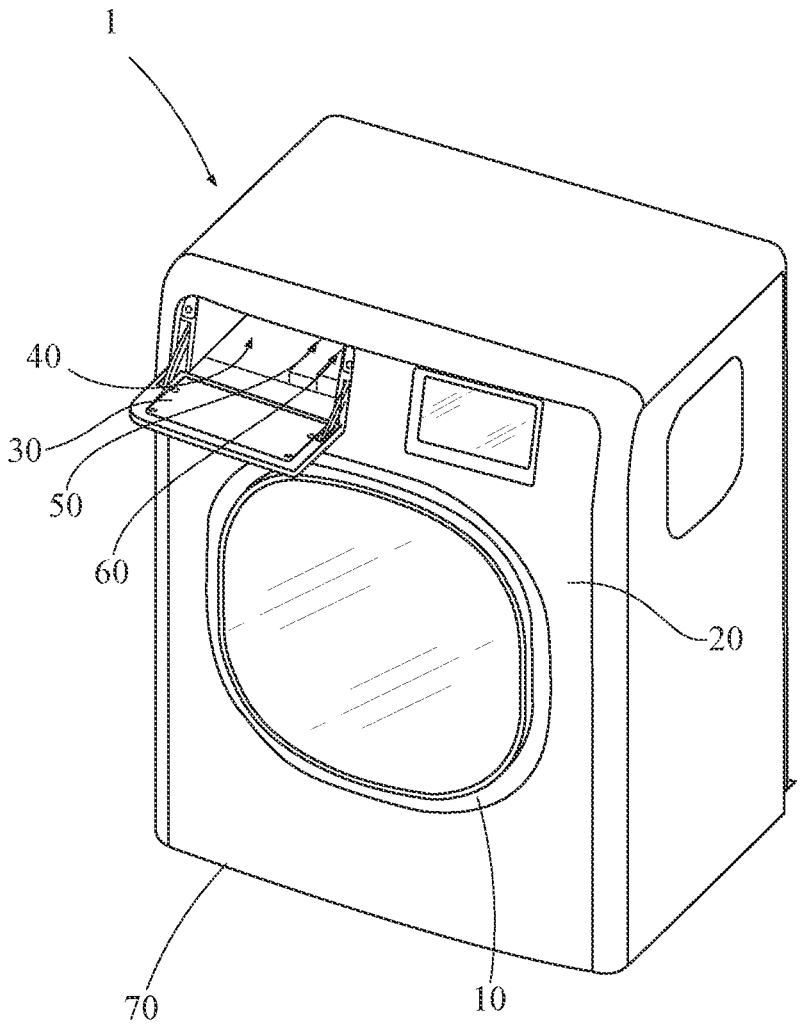
FIG. 1 is a perspective view of a laundry treatment apparatus.

Horizontal axis laundry treatment apparatuses are recognized as being convenient and efficient to use. Horizontal axis apparatuses come in a variety of sizes that are associated with the volume of the drum required to treat a given volume or mass of laundry. Urban dwellings are typically smaller than suburban or rural dwellings. Urban households often conduct the same activities as suburban and rural households within the smaller space of their dwelling. A consequence of this similarity is that appliances for urban households are more compactly designed or smaller than appliances designed for non-urban settings.

For horizontal axis laundry treatment apparatuses, one commonality is that the drum rotates around a horizontal axis or an axis that is close to horizontal. The drum of such an apparatus is typically accessed through a door on the front of the apparatus. The front door of the apparatus, when closed, seals against the tub that contains the drum.

The drum is typically a hollow cylinder, or generally cylindrical structure, having a generally circumferential peripheral wall, one closed end, and one open end, notwithstanding such variations in the circumferential peripheral wall provided for lifting the laundry as the drum intermittently rotates or for providing load stabilization when the drum spins rapidly. The circumferential wall has a plurality apertures that permit a treatment liquor and rinse water to move into and out of the drum. The tub, in combination with the door, contains the treatment liquor and rinse water. The tub is closely conformed to the drum so that the volume of treatment liquor and rinse water used during operation is minimized for efficient operation.

The remainder of the components of the laundry treatment apparatus are mostly positioned around or in back of the tub, except for the control panel for operating the apparatus. In many parts of the world, there are a few standard front to back and width dimensions for appliances that are designed to be installed under countertops or within cabinetry. The componentry of an apparatus is typically positioned within the apparatus so that the cabinet of the apparatus is in conformance with typical standard dimensions.

For various technical reasons, the front to back dimension of the drum is typically maximized within the front to depth dimension of the laundry treatment apparatus. As a consequence, as much of the componentry as practical is positioned around the circumference of the drum, recognizing that a tub in close conformance with the drum is between the componentry and the drum.

For a horizontal axis laundry treatment apparatus, the width of the apparatus cannot be less than the diameter of the drum if the cabinet of the laundry treatment apparatus has a generally parallelepiped shape. From a front view of the apparatus, the minimum cabinet extent about the drum is a square within which the drum fits. Practically the extent of the cabinet of the apparatus must be greater than the diameter of the drum so that the tub can also be fit within the width. When a square is fitted to the diameter of a circle, there are four regions between the periphery of the circle and the periphery of the square, one between the 12 and 3 o'clock positions, one between the 3 and 6 o'clock positions, one between the 6 and 9 o'clock positions, and one between the 9 and 12 o'clock positions, the 12 o'clock position being at one of the four points of intersection of the square and the circle. Even for a laundry treatment apparatus in which the cabinet is not so tightly fit around the tub, these general positions exist and can be convenient locations to position components of the laundry treatment apparatus.

The aforesaid positions are positions bound by the cabinet of the apparatus and the tub within which the drum is positioned. For a tub that closely fits around the drum, the tub will tend to be a hollow open ended cylinder that has a shape that is a slight expansion of the shape of the drum. In consideration of how a square fits around a circle there is more space available near the 1:30, 4:30, 7:30, and 10:30 o'clock positions than near 12, 3, 6, and 9 o'clock positions. The availability of space around the tub of the apparatus can influence where various components of the laundry treatment apparatus may be positioned.

A laundry treatment apparatus 1 is shown in FIG. 1. The laundry treatment apparatus 1 can have two or more receptacles into which individual containers of laundry treatment compositions can be inserted. These receptacles can be conveniently positioned to open towards the front of the laundry treatment apparatus 1. The laundry treatment apparatus 1 can have a door 10 to provide for access to the drum within the cabinet 20 of the laundry treatment apparatus 1. The receptacles can provide a location onboard the apparatus 1 for storing multiple doses of laundry treatment compositions that can be consumed by the laundry treatment apparatus 1 incrementally over multiple uses of the laundry treatment apparatus 1.

In treating laundry, users commonly use a detergent composition for mainly providing cleaning benefits. Cleaning benefits may be provided by components of the detergent composition including surfactants and enzymes. Other benefit agents may be provided in detergent compositions including polymers, deposition aids, hueing dyes, brightener, bleach, and the like. The detergent composition is delivered to the tub during the wash cycle of the laundry treatment apparatus 1.

As part of the rinse cycle of the laundry treatment apparatus 1, a fabric softener composition is often introduced to the tub. Fabric softening benefits can be provided by various fabric softening actives including, but not limited to, quaternary ammonium compounds, silicone, other polymers, and like materials. Fabric softener composition is typically delivered to the tub during the rinse cycle of the laundry treatment apparatus 1.

Typically users consume detergent composition at a rate that is greater than the rate at which they consume fabric softener composition. This can occur for multiple reasons. One is that the volume of each dose of detergent composition may be greater than the dose of fabric softener composition. Another reason is that many users do not use a fabric softener composition for each load of laundry. Users may choose whether or not use a fabric softener composition based on the fabric composition of the load of laundry, the anticipated use of the laundry after treatment, and to manage their overall costs associated with doing the laundry.

Many users of laundry treatment apparatuses 1 also desire to have their laundry smell nice after laundering and or during wear. Perfume composition may be introduced to the tub during the wash cycle, rinse cycle, or a special cycle designed for imparting a scent benefit to the laundry being treated. A perfume composition may include unencapsulated perfume, encapsulated perfume, deposition aid, and other constituents to aid with imparting a scent benefit to the laundry. Providing a perfume composition as a last or late step in the process of treating laundry may help reduce the amount of perfume required to deliver a particular level of benefit by minimizing loss via drainage of wash liquor or rinse water.

On a volume per load of laundry basis, a scent benefit can be imparted to the laundry using only a small volume of perfume composition. That is, per load, only a small volume of perfume composition is needed to provide a benefit that is noticeable to the user. Moreover, like the choice of users to use a fabric softener composition, similar choices are often made by consumers with respect to providing a scent benefit. Users may choose whether or not to use a perfume composition based on the fabric composition of the load of laundry, the anticipated use of the laundry after treatment, the wearer of the laundry after treatment, and managing the costs of doing laundry.

In view of the variation of the volume of laundry treatment compositions used over time, it can be generalized that the volume of detergent composition consumed is often greater than the volume of fabric softener composition consumed. And the volume of fabric softener composition consumed is often greater than the volume of perfume composition consumed.

The cabinet 20 can have an access panel 30 which can be openable and closable. The access panel 30 can provide for access to the detergent container receptacle 40, the fabric softener container receptacle 50, and the optional perfume container receptacle 60. The access panel 30 can be hingedly engaged with the cabinet 20, slideably engaged with the cabinet 20, or otherwise engageable with or engaged to the cabinet 20. The access panel 30 can be opened and closed to access the various receptacles.

The laundry treatment apparatus 1 can comprise an apparatus base 70 upon which the laundry treatment apparatus rests. The apparatus base 70 can be, by way of nonlimiting example, a flat bottom panel of the apparatus 1 or three or more projections, such as legs or wheels or the like, that rest upon the floor of the users household.

Figure 2:
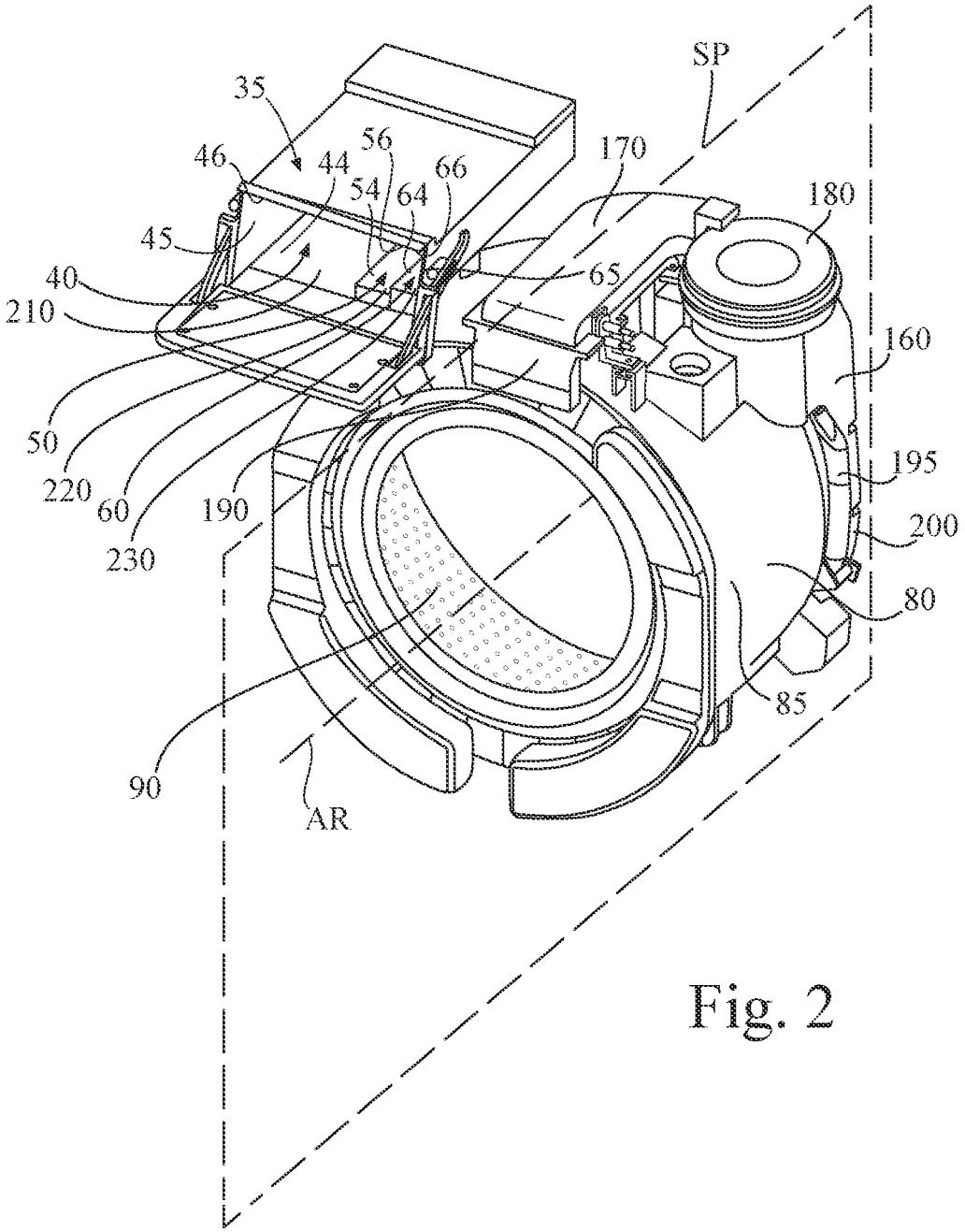
FIG. 2 is a perspective view of a portion of the interior components of a laundry treatment apparatus.

A laundry treatment apparatus 1 having the cabinet 20 and door 10 removed is shown in FIG. 2. Within the cabinet 20, laundry treatment apparatus 1 can comprise a tub 80, by way of nonlimiting example as shown in FIG. 2. The laundry treatment apparatus 1 can comprise a tub 80. The tub 80 defines a fluid containment envelope 85. The door 10 can be a sealingly engaged part of the fluid containment envelope 85. The tub 80 contains the fluid used during operation of the laundry treatment apparatus 1. During the wash and rinse cycles of the laundry treatment apparatus 1, the fluid may be a water based liquid. If the laundry treatment apparatus 1 is capable of washing and drying laundry, the fluid may be heated air provided during the drying cycle. The tub 80 is positioned above the apparatus base 70. The tub 80 may be fabricated from a rigid, semi-rigid, or compliant plastic or synthetic rubber material. The tub 80 may be fabricated from metal.

A drum 90 is positioned within the fluid containment envelope 85 and is rotatable relative to the tub 80 about an axis of rotation AR. The axis of rotation AR can be within about 20 degrees of horizontal relative to the apparatus base 70, the apparatus base 70 being understood as defining horizontal. The axis of rotation AR can be horizontal relative to the apparatus base 70. To provide for ergonomic access to the drum 80 when the user places and removes laundry from the drum 90, the drum 90 may be slightly tilted upwards from horizontal. The axis of rotation AR is the axis about which the drum 90 spins or reciprocates.

The axis of rotation AR is positioned in a sagittal plane SP of the drum 90. The sagittal plane SP divides the laundry treatment apparatus 1 into left and right portions and the term sagittal is used in its anatomical sense. The sagittal plane SP is orthogonal to the apparatus base 70.

The drum 90 can have a drum interior volume of from about 20 L to about 70 L, optionally from about 30 L to about 60 L, optionally about 30 L to about 50 L. The drum 90 can have an inside diameter ID from about 0.3 m to about 0.6 m, optionally from about 0.35 m to about 0.55 m, optionally from about 0.4 m to about 0.5 m, optionally from about 0.45 m to about 0.5 m.

The drum 90 can be mechanically engaged with a motor to drive rotation or partial rotation of the drum about the axis of rotation. The motor may be controlled by a controller that controls the laundry treatment apparatus 1 and implements a laundry treatment process. The controller can be a solid state or analog or other type of controller for operating the laundry treatment apparatus. The laundry treatment process controlled by the controller may include steps of determining the weight of the load of laundry, partially filling the tub 80 with water, pumping or otherwise transporting various laundry treatment compositions from the various containers to the tub 80. The controller can activate one or more pumps operably engaged with the ports of the receptacles to deliver fabric treatment composition to the tub 80 and drum 90. The controller may trigger the drum to rotate or partially rotate with the laundry treatment liquor in the tub 80. The controller may trigger a drain for the tub 80 to open and a pump to be activated to assist with removing spent laundry treatment liquor from the tub. The controller may implement a rinse process or a rinse process in which a fabric softener is introduced into or with the rinse water. And the controller may activate a drain and pump to remove rinse materials from the tub 80. Moreover, the controller may activate a drying cycle in which heated air is circulated by a fan through the tub 80 and drum 90 to dry the laundry while the drum 90 is rotated or intermittently rotated. During a wash cycle, the controller may sense conditions, by way of nonlimiting example, such as suds lock, temperature, liquid level, door open, and the like, and alter the operation of the laundry treatment apparatus 1 based on such sensed conditions. During a drying cycle, the controller may sense conditions, by way of nonlimiting example, including temperature and humidity. The controller may be programmed to provide for controlled starting and stopping of rotation of the drum 90.

The laundry treatment apparatus 1 can comprise a detergent container receptacle 40. The detergent container receptacle 40 has a detergent container receptacle volume. The laundry treatment apparatus 1 can further comprise a fabric softener container receptacle 50 having a fabric softener container receptacle volume. Optionally, the laundry treatment apparatus 1 can further comprise a perfume container receptacle 60 having a perfume container receptacle volume. The onboard receptacles provide spaces in which containers of laundry treatment compositions may be stored and be accessed by the apparatus 1 during use.

A receptacle is a structure within which a container can be positioned by the user. The receptacle is sized and dimensioned to receive the relevant container. Each container can contain a laundry treatment composition, for example a detergent composition, a fabric softener composition, and optionally a perfume composition. In practice, the user can acquire a container containing the relevant composition, access the receptacle, and position the container in the receptacle so that the relevant composition within the container can be delivered to the tub 80.

The receptacle volume of each respective receptacle is a scalar quantity of the volume of that receptacle. The receptacle volume is the volume within the laundry treatment apparatus 1 that is allocated for storing the container in which a laundry treatment composition is contained.

The detergent container receptacle volume can be from about 2% to about 8% of the drum interior volume. The fabric softener receptacle volume can be from about 0.5% to about 2% of the drum interior volume. The perfume receptacle volume can be from about 0.3% to about 1.5% of the drum interior volume. The fabric softener receptacle volume can be from about 15% to about 30% of the detergent container receptacle volume. And the perfume container receptacle volume can be from about 10% to about 25% of the detergent container receptacle volume. Within these ranges of volume of the receptacles relative to the drum interior volume or relative to one another, the detergent container receptacle volume can be greater than the fabric softener container receptacle volume and the fabric softener container receptacle volume can be greater than the perfume container receptacle volume.

A receptacle may be an enclosure or open frame or partial frame or partial enclosure or open space or partially open space within which the relevant container is intended to be positioned. That is, the respective receptacle is space within which the respective container is intended to be placed as part of operation of the apparatus by the user. The receptacle volume is taken to be the maximum volume that the receptacle is designed accommodate without the container in one receptacle intruding upon the space allocated to another receptacle for accommodating another container. Receptacles may be walled off from one another or receptacles may be defined or partially defined by an open frame or tray or other structure in which it is suitable to firmly position a container and properly engage the container with the port that provides for transport of the laundry treatment composition from the container into the tub 80 and drum 90. The detergent container receptacle 40 can comprise a detergent container receptacle bottom wall 44, a detergent container receptacle side wall 45, and a detergent container receptacle top wall 46, the detergent container receptacle top wall 46 being spaced apart from the detergent container receptacle bottom wall 44 and the detergent container receptacle side wall 45 connecting the detergent container receptacle bottom wall 44 and the detergent container receptacle top wall 46. The extent of the detergent container receptacle bottom wall 44, detergent container receptacle side wall 45, and detergent container receptacle top wall 46 can define the detergent container receptacle 40.

Likewise, the fabric softener container receptacle 50 can comprise a fabric softener container receptacle bottom wall 54 and a fabric softener container receptacle top wall 56, the fabric softener container receptacle top wall 56 being spaced apart from the fabric softener container receptacle bottom wall 54. The detergent container receptacle 40 can be further away from the sagittal plane SP than the fabric softener container receptacle 50. And the perfume container receptacle 60 can comprise a perfume container receptacle bottom wall 64, a perfume container receptacle side wall 65, and perfume container receptacle top wall 66, the perfume container receptacle bottom wall 64 being spaced apart from the perfume container receptacle top wall 66 and the perfume container receptacle side wall 65 connecting the perfume container receptacle bottom wall 64 and the perfume container receptacle top wall 66. The fabric softener container receptacle 50 can be between the detergent container receptacle 40 and the perfume container receptacle 60. Each of the receptacles can be defined by or at least partially defined by a back wall connecting the various top walls to the various bottom walls. The various top walls may be integral with one another to form a single top wall. Likewise, the various bottom walls may be integral with one another to form a single bottom wall.

The detergent container receptacle 40 and fabric softener container receptacle 50 can be within the docking unit 35. And the perfume container receptacle 60, if present, can also be within the docking unit 35. The docking unit 35 can be a defined space or partially defined space within the apparatus 1 within which the detergent container receptacle 40, fabric softener container receptacle 50, and optional perfume container receptacle 60 are positioned. The various receptacles can be a continuous space within the docking unit 35 defined by the various walls described above. Each of the receptacles can also be at least partially defined by the port valve or valves associated with the respective receptacle, each respective receptacle being intended to be associated with a respective container.

Each of the containers contain multiple doses of the respective laundry treatment composition. For example, each container may contain more than about 10 doses of laundry treatment composition, or even more than about 20, or more than about 30, or from about 10 to about 50, or from about 20 to about 40, doses of laundry treatment composition.

Since space within a small laundry treatment apparatus 1 is limited, considerable attention must be directed towards packing in the various components of the laundry treatment apparatus 1 within a compact cabinet 20. Relatively large spaces are available in a compact laundry treatment apparatus 1 near the 10:30 and 1:30 positions, the 12 o'clock and 6 o'clock positions being in the sagittal plane and the 12 o'clock position being above the 6 o'clock position and the 6 o'clock position being above the apparatus base 70. Furthermore, the tub 80 may be tightly conforming to the drum 90 to minimize the volume of liquid required to treat the laundry. That is, the tub 80 may be curved around the axis of rotation AR, in tight or close conformance with the drum 90.

Over time, the volume of detergent composition consumed will tend to be larger than the volume of fabric softener composition consumed. And if a perfume composition is used, the volume of fabric softener composition consumed will be larger than the volume of the perfume composition consumed. In view of that, the detergent container receptacle volume should be greater than the fabric softener container receptacle volume and the fabric softener container receptacle volume should be greater than the perfume container receptacle volume. That way the volume within the cabinet 20 for storing each individual laundry treatment composition is approximately proportional to the consumption of such individual compositions.

The detergent container receptacle 40 can be positioned further away from the sagittal plane SP than the fabric softener container receptacle 50. Likewise, the fabric softener container receptacle 50 can be positioned further away from the sagittal plane SP than the perfume container receptacle 60.

It can be practical to provide the detergent container receptacle 40, fabric softener container receptacle 50, and the optional perfume container receptacle 60 to be elevationally higher than the axis of rotation AR when the laundry treatment apparatus 1 is in operable position. The operable position of the laundry treatment apparatus 1 is with the apparatus base 70 resting on a floor or countertop or other substantially flat surface. With respect to the term elevationally higher as it pertains to the position of elements of the invention, elevation is determined relative to apparatus base 70. The apparatus base 70 is the datum for characterizations of elevation. Such location can help to reduce the power required to transport the individual laundry treatment compositions to the tub 80 and can be more convenient for the user to gain access to the receptacles to as compared to the receptacles being at the bottom of the apparatus 1. Elevationally higher and elevationally lower are used with reference to the laundry treatment apparatus being in operable position.

As described herein, the apparatus 1 comprises multiple receptacles into which a container of an individual laundry treatment composition can be inserted. To help users of the apparatus 1 place the correct container in the correct receptacle, it may be helpful to provide cues to the user that aid with the user positioning the right container in the right receptacle. Geometric cues may be particularly helpful.

The apparatus 1 can be a combination washing machine and dryer. Such an apparatus 1 is particularly attractive to compact urban households that do not have space for both a washer and dryer. Combination washing and drying machines can employ a closed drying air circuit since many compact urban households do not have vents installed for such apparatuses.

A laundry treatment apparatus 1 comprising a closed drying air circuit 160 is shown in FIG. 2. The closed drying air circuit 160 can include a heater 170. The heater 170 can heat air circulated in the closed drying air circuit 160. A fan 180 can be provided in the closed drying air circuit 160 to circulate heated air from the heater 170 through the tub 80 and drum 90 to remove moisture from the laundry during drying. The closed drying air circuit 160 can further comprise a condenser 195 to collect water from within the closed drying air circuit 160. The closed drying air circuit 160 can comprise a heater 170 in thermal communication with a heated air conveyance 190. The closed drying air circuit 160 can comprise the heated air conveyance 190, heater 170, tub 80, drum 90, return 200, condenser 195, and fan 180. The heated air conveyance 190 and return 200 are in fluid communication with the tub 80 and drum 90. The heated air conveyance 190 and return 200 are part of a closed loop that circulates heated air through the heated air conveyance 190, drum 90, return 200, condenser 195, and fan 180. The heated air conveyance 190 is upstream of the drum 90 and the return 200 is downstream of the drum 90. The heater 170 is upstream of the drum 90. The heater 170 can be within or part of the heated air conveyance 190. The heated air flows from the heated air conveyance 190 to the tub 80 and drum 90 to the return 200. Circulating heated air through the tub 80 and drum 90 can remove water from the laundry to dry or at least partially dry the laundry. The heater 170 can be a heating element that converts electrical energy into heat via Joule heating. The heating element can be a wire or ribbon, straight or coiled. The fan 180 can drive airflow across or through the heater 170 and the air is heated as it passes the heater 170.

Some laundry treatment compositions are sensitive to heat. For example, excessive heat can cause the activity of enzymes to decrease. Detergent compositions commonly include enzymes as an active for stain removal. Furthermore, heat can destabilize stabilized compositions such as detergent compositions, fabric softener compositions, and perfume compositions. For a laundry treatment apparatus 1 that accommodates onboard storage of laundry treatment compositions, such as that described herein, and has heater 170 that is part of a closed air drying circuit 160 it can be important to separate the receptacles where the laundry treatment compositions are stored from the heater 170 by some distance. The perfume container receptacle 60 can be separated from the heater 170 by a distance that is from about 5% to about 35% of the inside diameter ID of the drum. Such an arrangement can provide for separation between the perfume container receptacle 60 and the heater 170 so that the contents of the perfume container are protected from the deleterious effects of excessive heat.

The heater 170 can be positioned elevationally higher than the axis of rotation AR and the sagittal plane SP can be between the detergent container receptacle 40 and at least a portion of the heater 170. The heater 170 is the heating element to which an electric current is applied to heat the heating element. In effect, this spaces apart the detergent container receptacle 40 and the heater 170 into different parts of or potentially even opposite halves of the laundry treatment apparatus 1 and can provide for separation distance between the detergent composition and the heater. Since heat conduction can be roughly approximated as being proportional to the square of the distance between the source of heat and the recipient of heat, notwithstanding the heterogeneous structure that might exist there between and dynamic boundary conditions and air flow, a small increase in the distance of separation can provide a substantial benefit in terms of limiting the increase in temperature of the detergent composition positioned in the detergent container receptacle 40 due to the heater 170. A similar separation between the heater 170 and the detergent container receptacle 40 can be achieved by positioning the heater 170 elevationally lower than the axis of rotation AR. This positions the detergent container receptacle 40 and the heater 170 in opposite top and bottom halves of the laundry treatment apparatus 1 when the detergent container receptacle 40 is elevationally higher than the axis of rotation AR.

Relatively large spaces are available elevationally higher than the axis of rotation AR near the 10:30 and 1:30 positions when the laundry treatment apparatus 1 is in an operable position. To provide for volumes of laundry treatment compositions that are balanced based on consumption, it can be practical to vary the elevational position of the bases of each container receptacle. Comparatively more vertical space is available within the cabinet 20 further away from the sagittal plane SP than nearer to the sagittal plane SP.

Further, the height of the receptacles can vary, height being measured in a direction orthogonal to the apparatus base 70. Varying the height of the receptacles can provide a cue as to into which receptacle which container should be positioned if the containers have different heights. Providing receptacles dimensioned as such can provide for laundry treatment compositions that are available onboard the laundry treatment apparatus 1 in quantities that are related to one another in approximate proportion to their expected consumption.

The receptacles can be approximately centered about the axis of rotation AR. That is the center point of each receptacle can be about the same distance from the axis rotation as the center points of the other receptacles. The center point of a receptacle is the center of mass of the space allocated to the receptacle. The center of mass of a three dimensional space is determined using known analytical or numerical methods.

The receptacles can be positioned within a docking unit 35. The docking unit 35 can comprise an access panel 30. The access panel 30 can be hingedly openable and provide access to the interior of the docking unit 35. The interior of the docking unit comprises the detergent container receptacle 40, fabric softener container receptacle 50, and optional perfume container receptacle 60. In operation, the user opens the docking unit access panel 30, and inserts or removes the respective container into or from the respective receptacle. The detergent container can be inserted or removed from the detergent container receptacle 40. The fabric softener container can be inserted or removed from the fabric softener container receptacle 60. And the optional perfume container can be inserted or removed from the perfume container receptacle 60.

Figure 3:
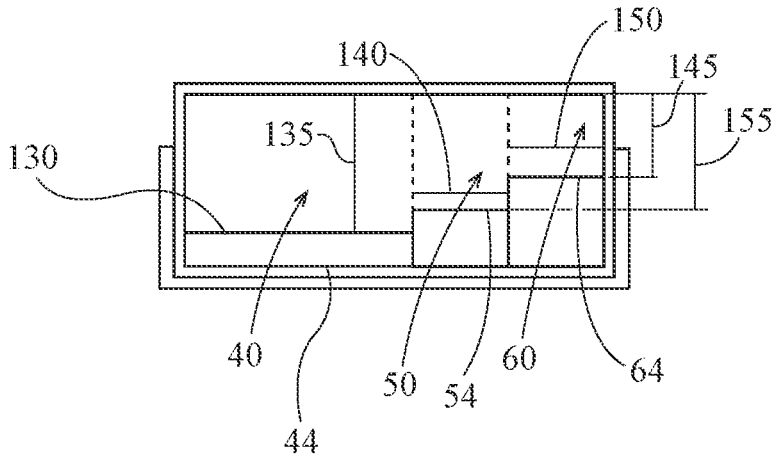
FIG. 3 is a front view of the container docking unit.

The detergent container receptacle 40 can have a detergent container receptacle transverse width 130 orthogonal to the sagittal plane SP (FIG. 3). Similarly, the fabric softener container receptacle 50 can have a fabric softener container receptacle transverse width 140 orthogonal to the sagittal plane SP. If present, the perfume container receptacle 60 can have a perfume container receptacle transverse width 150 orthogonal to the sagittal plane SP. Each of the aforesaid widths are scalar measurements of the dimension of the respective receptacle. The detergent container receptacle transverse width 130 can be greater than the fabric softener container receptacle transverse width 140 and the perfume container receptacle transverse width 150. Further, the fabric softener container receptacle transverse width 140 can differ from the perfume container receptacle transverse width 150. The transverse widths of the respective receptacles is the transverse width within which the respective container fits. By way of nonlimiting example, if the receptacle is a drawer having sidewalls, the transverse width is the distance between the interior of the side walls. By way of nonlimiting example, if the receptacle is an open frame, the transverse width is the interior distance between the interior transverse boundaries of the open frame. By way of nonlimiting example, if the receptacle is an open space, by way of nonlimiting example, as shown, the transverse width is the distance between the transverse boundaries of the open space in which the respective container fits. The transverse width of each respective receptacle is measured at the center point of the respective receptacle.

Since the detergent composition may be consumed in the largest volume over time, providing a large detergent container receptacle transverse width 130 relative to the fabric softener container receptacle transverse width 140 and the perfume container receptacle transverse width 150 can, in part, provide for adequate space to store a large volume of detergent composition onboard the apparatus 1. Moreover, the difference in transverse width amongst the receptacles can help the user match the correct container with the correct receptacle so that the apparatus 1 will function as intended.

The detergent container receptacle 40 can have a detergent container receptacle bottom wall 44 forming the lower boundary of the detergent container receptacle 40. Likewise the fabric softener receptacle 50 can have fabric softener receptacle bottom wall 54 forming the lower boundary of the fabric softener container receptacle 50. And the perfume container receptacle 60 can have a perfume container receptacle bottom wall 64 forming the lower boundary of the perfume container receptacle 60. The detergent container receptacle bottom wall 44 can be lower relative to the apparatus base 70 than the fabric softener container bottom wall 54. And the fabric softener container receptacle bottom wall 54 can be lower relative to the apparatus base 70 than the perfume container receptacle bottom wall 64. With the detergent container receptacle 40 outboard of the fabric softener container receptacle 50 relative to the axis of rotation AR and the fabric softener receptacle 50 outboard of the perfume container receptacle 60 relative to the axis of rotation AR, and the receptacle bottom walls positioned as such, the volume of detergent composition carried onboard the apparatus 1 can be greater than the volume of fabric softener composition carried onboard the apparatus 1. And the volume of fabric softener composition carried onboard the apparatus 1 can be greater than the volume of perfume composition carried onboard the apparatus 1. The bottom wall of the respective receptacle is the bottom position within the respective receptacle that defines the space within which the respective container fits. By way of nonlimiting example, if the receptacle is a drawer, the bottom wall of the drawer is the bottom of the interior of the drawer, the interior of the drawer defining the receptacle. By way of nonlimiting example, if the receptacle is an open frame or open space, the bottom wall is the location defining the bottom of the space defined to accommodate the receptacle.

The detergent container receptacle 40 can have a detergent container receptacle height 135 from about 14% to about 22%, optionally from about 15% to about 20%, optionally about 18%, of the inside diameter ID of the drum 90. The fabric softener container receptacle 50 can have a fabric softener container receptacle height 155 from about 11% to about 18%, optionally about 13% to about 15%, optionally about 14%, of the inside diameter ID of the drum 90. The perfume container receptacle 60 can have a perfume container receptacle height 145 from about 8% to about 14%, optionally about 10% to about 13%, optionally about 12%, of the inside diameter ID of the drum 90. The detergent container receptacle height 135 can be greater than the fabric softener container receptacle height 155. And the fabric softener container receptacle height can be greater than the perfume container receptacle height 145. Providing receptacles dimensioned as such can provide for laundry treatment compositions that are available onboard the laundry treatment apparatus 1 in quantities that are related to one another in approximate proportion to their expected consumption.

Figure 4:
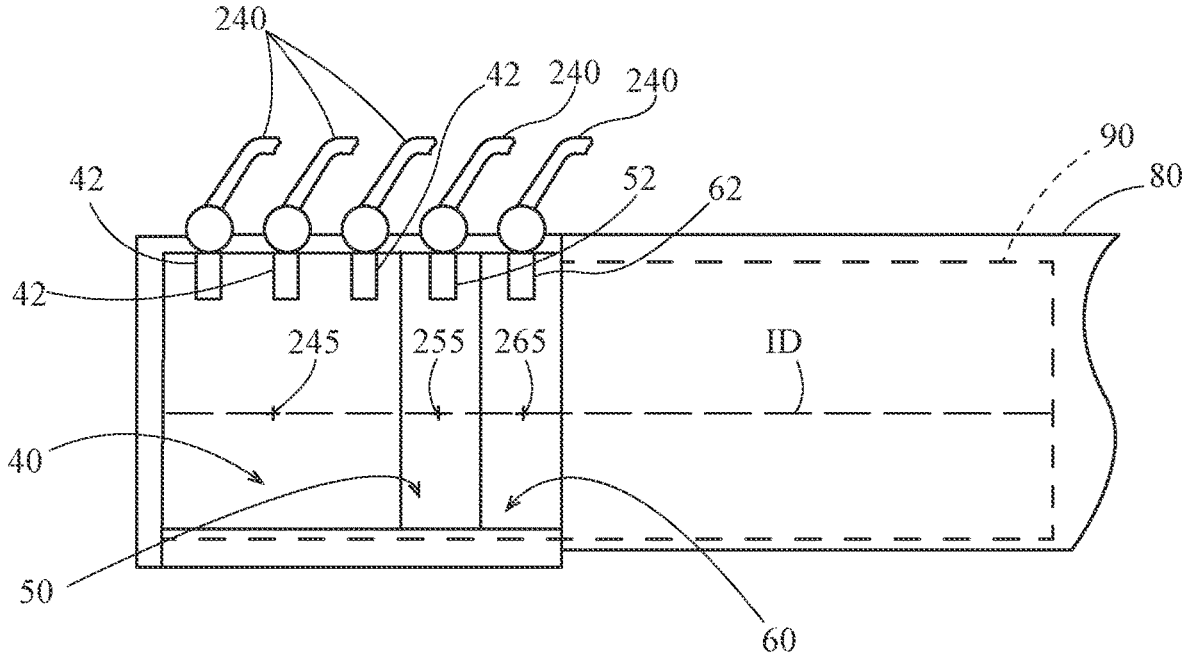
FIG. 4 is a top view of a portion of the laundry treatment apparatus, with the top panel removed so that the interior of the docking unit is visible.

The drum 90 has an inside diameter ID which is taken to be the maximum diameter of the interior of the drum 90, as shown in FIG. 4, which is a top view of a portion of the laundry treatment apparatus 1. The detergent container receptacle 40 has a detergent container receptacle center point 245. The fabric softener container receptacle 50 has a fabric softener container receptacle center point 255. And the perfume container receptacle 60 has a perfume container receptacle center point 265. Each of detergent container receptacle center point 245, fabric softener receptacle center point 255, and perfume container receptacle center point 265 can be separated from the axis of rotation by less than about 85% of the inside diameter ID. The center points of the receptacles are thereby tucked in relatively closely and uniformly about the tub 80 thereby making it easier to connect the containers to the tub 80 in some manner. The respective center points are the center points of the receptacles designed to accommodate the respective container. The individual receptacles designed to accommodate individual containers are three dimensional spaces designed to accommodate the respective container, meaning that the center points for each individual receptacle is the center of mass of the respective three dimensional space.

The detergent container receptacle 40 can have a detergent container receptacle inlet port valve 42 that is in fluid communication with the tub 80 and drum 90. Likewise, the fabric softener container receptacle 50 can have a fabric softener container receptacle inlet port valve 52 in fluid communication with the tub 80 and drum 90 and the perfume container receptacle 60 can have a perfume container receptacle inlet port valve 62 in fluid communication with the tub 80 and drum 90. The inlet ports can be a quick connect type port that can easily provide a connection between the container that is placed in the receptacle and conveyance between the inlet port and the drum 90. The inlet ports can be half of a ball and sleeve connection, half of a cam-lock fitting, half of a luer lock, half of an o-ring face seal, or half of a push to connect fitting. The other complementary half of the fitting can be on outlet of the container that contains the respective laundry treatment composition. The inlet ports can provide for a tactile sensation when the respective container is properly engaged with the respective port. Similarly, the inlet ports can provide for a tactile sensation when the respective container is separated from the respective port. For example, the user can feel a clicking sensation when a container is properly engaged with a port.

Feed tubes 240 can be provided downstream of the inlet ports to convey the respective laundry treatment composition to a pump that transports the laundry treatment composition to the tub 80. Optionally the feed tubes 240 can convey the respective laundry treatment composition to a metering device that regulates the mass or volume of the laundry treatment composition that is transported to the tub 80. Feed tubes can be TYGON tubing, polypropylene tubing, polyethylene tubing, or other similar flexible plastic tubing or metal tubing. The respective laundry treatment composition can be driven from its respective container by a peristaltic pump.

Figure 5:
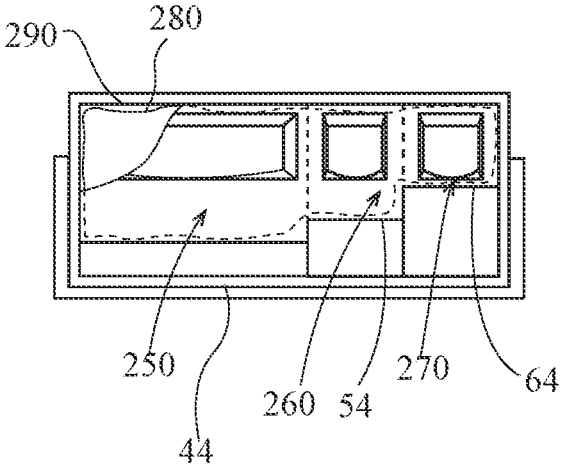
FIG. 5 is a front view of a portion of the laundry treatment apparatus.

The user can install the containers of fabric treatment composition into the proper receptacle, as shown in FIG. 5. The detergent container 250 can be positioned within the detergent container receptacle 40 to be in fluid communication with the detergent container receptacle inlet port valve 42. The fabric softener container 260 can be positioned within the fabric softener container receptacle 50 to be in fluid communication with the fabric softener container receptacle inlet port valve 52. And the perfume container 270 can be positioned within the perfume container receptacle 60 to be in fluid communication with the perfume container receptacle inlet port valve 62. The user can prepare the relevant container as instructed and then carefully fit the container into the respective receptacle and fit the container to the relevant inlet port. The receptacles may have structural features into which the container is seated to ensure a proper connection between the container and the inlet port. Likewise, the user can remove the containers of fabric treatment composition from their respective receptacles.

The detergent container 250, fabric softener container 260, and perfume container 270 can each comprise a shell 290 and a flexible bag 280 within the shell 290. Containers that comprise a collapsible flexible bag 280 within a shell 290, rigid, semi-rigid, or the like, can be practical for the containers of fabric treatment compositions. For example, bag in box and bag in bottle type containers may be suitable. These types of containers are well suited for dispensing laundry treatment compositions without the need for venting of the interior of the bag. As the laundry treatment composition is dispensed, the flexible bag 280 collapses incrementally with the volume of laundry treatment composition dispensed. The shell 290 can protect the flexible bag 280 from damage through the supply chain from manufacture to use.

The detergent container volume can be from about 2% to about 8% of the drum interior volume. The fabric softener container volume can be from about 0.5% to about 2% of the drum interior volume. The perfume container volume can be from about 0.3% to about 1.5% of the drum interior volume. The fabric softener container volume can be from about 15% to about 30% of the detergent container volume. And the perfume container volume can be from about 10% to about 25% of the detergent container volume. Within these ranges of volume of the containers relative to the drum interior volume or relative to one another, the detergent container volume can be greater than the fabric softener container volume and the fabric softener container volume can be greater than the perfume container volume. And moreover, the volume of the laundry treatment compositions can be provided in volumes proportional to one another that are proportional to their consumption during use over time. As such, the containers of laundry treatment compositions can be expected to be emptied after roughly the same number of uses of the laundry treatment apparatus 1.

In consideration of the crowded nature within a compact laundry treatment apparatus 1, especially one that is combination washer and dryer, the receptacles can be positioned to take advantage of or create available space, with respect to performance of the laundry treatment apparatus 1, within the cabinet 20 for the receptacles. A cabinet 20 having a parallelepiped shape may have insufficient space within the interior of the cabinet 20 to store great enough volume of the individual laundry treatment compositions to enable the containers to last enough washing cycles to be satisfying and convenient to the user. This might be the case even if location of the receptacles for fabric treatment compositions are properly positioned. Further, the height of the cabinet 20 can be a fixed constraint based on local standards for countertop height. When the receptacles are nested in closely about the tub 80 and the top of the cabinet 20 is a substantially planar surface, the available interior volume of the cabinet 20 for the receptacles becomes more and more cramped the closer the receptacle is to the sagittal plane SP.

Figure 6:
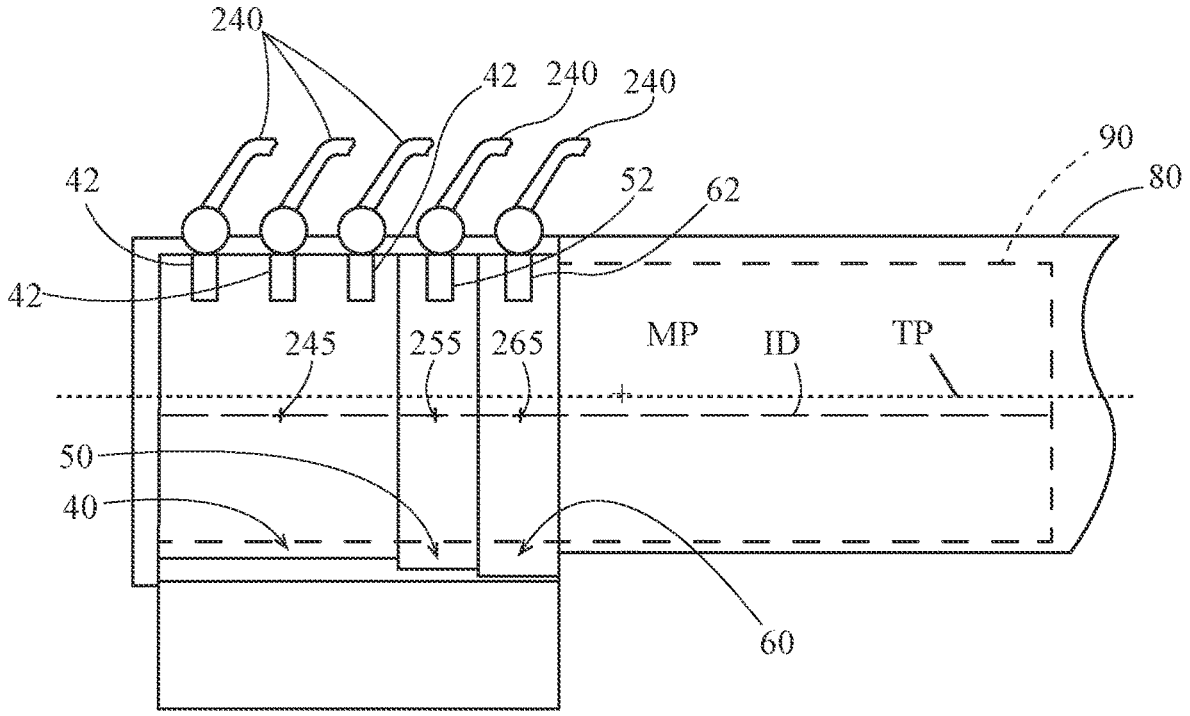
FIG. 6 is a top view of a portion of the interior components of a laundry treatment apparatus.

One way of increasing the volume of space available for the containers is to position the receptacles so that they project outwardly further than other portions of the front of the laundry treatment apparatus, as shown in FIG. 6. The transvers plane TP is perpendicular to the apparatus base 70 and intersects the midpoint MP of the axis of rotation AR. The midpoint MP is located midway between the open end and closed end of the hollow generally cylindrically shaped drum 90. The receptacle closest to the sagittal plane SP can be the most space constrained receptacle. In general, the degree of space constraint tends to decrease with increasing distance away from the sagittal plane SP. Thus, if a perfume container receptacle 60 is provided, the perfume container receptacle 60 can be the most space constrained. Even if the volume of perfume composition consumed per use is smaller than the volume of fabric softener composition and detergent composition consumed per use, there may be inadequate space available for a large enough perfume container 270 to be fit within the cabinet 20. The perfume container receptacle 60 can project further away from the transverse plane TP than the fabric softener container receptacle 50. And the fabric softener container receptacle 50 can project further away from the transverse plane TP than the detergent container receptacle 40. In this arrangement, extra interior space is provided for the perfume container receptacle 60 so that an adequate volume of perfume composition can be installed in the laundry treatment apparatus 1. And extra interior space is provided for the fabric softener container receptacle 50 so that an adequate volume of fabric softener composition can installed onboard the laundry treatment apparatus 1. The transverse plane TP is perpendicular to the apparatus base 70, intersects the midpoint MP of the axis of rotation AR, and is perpendicular to the sagittal plane SP.

Combinations:

A. A laundry treatment apparatus (1) comprising:
- an apparatus base (70) upon which said laundry treatment apparatus rests;
- a tub (80) defining a portion of a fluid containment envelope (85), wherein said tub is above said apparatus base;
- a drum (90) positioned within said tub and rotatable relative to said tub about an axis of rotation (AR) that is within about 20 degrees of horizontal relative to said base, wherein said axis of rotation is in a sagittal plane (SP) of said drum, wherein said sagittal plane is orthogonal to said apparatus base;

a detergent container receptacle (40);

a fabric softener container receptacle (50);

a perfume container receptacle (60);

wherein said detergent container receptacle is further away from said sagittal plane than said fabric softener container receptacle and said fabric softener container receptacle is further away from said sagittal plane than said perfume container receptacle;

wherein said detergent container receptacle, said fabric softener container receptacle, and said perfume container receptacle are elevationally higher than said axis of rotation when said laundry treatment apparatus is in operable position.

B. The laundry treatment apparatus according to Paragraph A, wherein said detergent container receptacle has a detergent container receptacle volume, wherein said fabric softener container receptacle has a fabric softener container receptacle volume, wherein said perfume container receptacle has a perfume container receptacle volume, wherein said detergent container receptacle volume is greater than said fabric softener container receptacle volume and said fabric softener container receptacle volume is greater than said perfume container receptacle volume.

C. The laundry treatment apparatus according to Paragraph A or B, wherein said detergent container receptacle has a detergent container receptacle transverse width (130) orthogonal to said sagittal plane, wherein said fabric softener container receptacle has fabric softener container receptacle transverse width (140) orthogonal to said sagittal plane, wherein said perfume container receptacle has a perfume container receptacle transverse width (150) orthogonal to said sagittal plane, wherein said detergent container receptacle transverse width is greater than said fabric softener container receptacle transverse width and said perfume container receptacle transverse width, wherein said fabric softener container receptacle transverse width differs from said perfume container receptacle transverse width.

D. The laundry treatment apparatus according to Paragraphs A to C, wherein said laundry treatment apparatus further comprises a heater (170) in thermal communication with a heated air conveyance (190) and said heated air conveyance is in fluid communication with said drum: wherein said sagittal plane is between said detergent container receptacle and at least a portion of said heater and said heater is elevationally higher than said axis of rotation; or wherein said heater is elevationally lower than said axis of rotation.

E. The laundry treatment apparatus according to any of Paragraphs A to D, wherein said detergent container receptacle has a detergent container receptacle bottom wall (44), wherein said fabric softener container receptacle has a fabric softener container receptacle bottom wall (54), wherein said perfume container receptacle has a perfume container receptacle bottom wall (64), wherein said detergent container receptacle bottom wall is lower relative to said apparatus base than said fabric softener container receptacle bottom wall and said fabric softener container receptacle bottom wall is lower relative to said apparatus base than said perfume container receptacle bottom wall.

F. The laundry treatment apparatus according to any of Paragraphs A to E, wherein said drum has an inside diameter (ID), wherein said detergent container receptacle has a detergent container receptacle center point (245), wherein said fabric softener container receptacle has a fabric softener container receptacle center point (255), wherein said perfume container receptacle has a perfume container receptacle center point (265), wherein each of said detergent container receptacle center point, said fabric softener container receptacle center point, and said perfume container receptacle center point are separated from said axis of rotation by less than about 85% of said inside diameter.

G. The laundry treatment apparatus according to any of Paragraphs A to F, wherein said detergent container receptacle has a detergent container receptacle inlet port valve (42) in fluid communication with said drum, wherein said fabric softener container receptacle has a fabric softener container receptacle inlet port valve (52) in fluid communication with said drum, and wherein said perfume container receptacle has a perfume container receptacle inlet port valve (62) in fluid communication with said drum.

H. The laundry treatment apparatus according to Paragraph G, wherein a detergent container (250) is positioned within said detergent container receptacle and is in fluid communication with said detergent container receptacle inlet port valve, wherein a fabric softener container (260) is positioned within said fabric softener container receptacle and is in fluid communication with said fabric softener container receptacle inlet port valve, and wherein a perfume container (270) is positioned within said perfume container receptacle and is in fluid communication with said perfume container receptacle inlet port valve.

I. The laundry treatment apparatus according to Paragraph H, wherein said detergent container, said fabric softener container, and said perfume container each comprise a shell (290) and flexible bag (280) within said shell.

J. The laundry treatment apparatus according to any of Paragraphs A to I, wherein said perfume container receptacle projects further away from a transverse plane (TP) than said fabric softener container receptacle and said fabric softener container receptacle projects further away from said transverse plane than said detergent container receptacle, wherein said transverse plane is perpendicular to said base and intersects a midpoint (MP) of said axis of rotation and is perpendicular to said sagittal plane.

K. The laundry treatment apparatus according to any of Paragraphs A to J, wherein said laundry treatment apparatus further comprises a heater (170) in thermal communication with a heated air conveyance (190) and said heated air conveyance is in fluid communication with said drum, wherein said drum has an inside diameter (ID), wherein said detergent container receptacle is separated from said heater by a distance of at least 15% of said inside diameter.

L. The laundry treatment apparatus according to any of Paragraphs A to K, wherein said laundry treatment apparatus further comprises a heater (170) in thermal communication with a heated air conveyance (190) and said heated air conveyance is in fluid communication with said drum, wherein said drum has an inside diameter (ID), wherein said perfume container receptacle is separated from said heater by a distance of at least 3% of said inside diameter.

M. A laundry apparatus (1) comprising:

a base (20) upon which said laundry treatment apparatus rests;

a tub (80) defining a portion of a fluid containment envelope (85), wherein said tub is above said base;

a drum (90) positioned within said tub and rotatable relative to said tub about an axis of rotation (AR) that is within about 20 degrees of horizontal, wherein said axis of rotation is in a sagittal plane (SP) of said drum, wherein said sagittal plane is orthogonal to said base; a detergent container receptacle (40);

a fabric softener container receptacle (50);

wherein said detergent container receptacle is further away from said sagittal plane than said fabric softener container receptacle;

a heater (170), wherein said sagittal plane is between said detergent container receptacle and at least a portion of said heater, wherein said heater is engaged with a heated air conveyance (190) and said heated air conveyance is in fluid communication with said drum.

N. The laundry treatment apparatus according to Paragraph M, wherein said detergent container receptacle has a detergent container receptacle volume, wherein said fabric softener container receptacle has a fabric softener container receptacle volume, wherein said detergent container receptacle volume is greater than said fabric softener container receptacle volume.

O. The laundry treatment apparatus according to Paragraph M or N, wherein said detergent container receptacle has a detergent container receptacle transverse width (130) orthogonal to said sagittal plane, wherein said fabric softener container receptacle has a fabric softener container receptacle transverse width (140) orthogonal to said sagittal plane, wherein said detergent container receptacle transverse width is greater than said fabric softener container receptacle transverse width.

P. The laundry treatment apparatus according to Paragraph M to O, wherein said detergent container receptacle has a detergent container receptacle inlet port valve (42) in fluid communication with said drum and wherein said fabric softener container receptacle has a fabric softener container receptacle inlet port valve (52) in fluid communication with said drum.

Q. The laundry treatment apparatus according to any of Paragraphs M to P, wherein a detergent container (250) is positioned within said detergent container receptacle and is in fluid communication with said detergent container receptacle inlet port valve, and wherein a fabric softener container (260) is positioned within said fabric softener container receptacle and is in fluid communication with said fabric softener container receptacle inlet port valve.

R. The laundry treatment apparatus according to any of Paragraphs M to Q, wherein said fabric softener container receptacle projects further away from a transverse plane (TP) than said detergent container receptacle, wherein said transverse plane is perpendicular to said base and intersects a midpoint (MP) of said axis of rotation and is perpendicular to said sagittal plane.

S. The laundry treatment apparatus according to any of Paragraphs M to R, wherein said detergent container receptacle has a detergent container receptacle bottom wall (44), wherein said fabric softener container receptacle has a fabric softener container receptacle bottom wall (54), wherein said detergent container receptacle bottom wall is lower relative to said apparatus base than said fabric softener container receptacle bottom wall.

T. The laundry treatment apparatus according to any of Paragraphs M to S, wherein said drum has an inside diameter (ID), wherein said detergent container receptacle has a detergent container receptacle center point (245), wherein said fabric softener container receptacle has a fabric softener container receptacle center point (255), wherein each of said detergent container receptacle center point and said fabric softener container receptacle center point are separated from said axis of rotation by less than about 85% of said inside diameter.

U. The laundry treatment apparatus according to any of Paragraphs M to T, wherein a detergent container (250) is positioned within said detergent container receptacle and is in fluid communication with said detergent container receptacle inlet port valve, and wherein a fabric softener container (260) is positioned within said fabric softener container receptacle and is in fluid communication with said fabric softener container receptacle inlet port valve, optionally wherein said detergent container and said fabric softener container each comprise a shell (290) and flexible bag (280) within said shell.

V. The laundry treatment apparatus according to any of Paragraphs M to U, wherein said drum has an inside diameter (ID), wherein said detergent container receptacle is separated from said heater by a distance of at least 15% of said inside diameter.

W. The laundry treatment apparatus according to any of Paragraphs M to V, wherein said heater is elevationally higher than said axis of rotation when said laundry treatment apparatus is in operable position.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

What is claimed is:

1. A laundry treatment apparatus comprising:

a base upon which said laundry treatment apparatus rests;

a tub defining a portion of a fluid containment envelope, wherein said tub is above said base;

a drum positioned within the tub and rotatable relative to the tub about an axis of rotation that is within 20 degrees of horizontal, wherein said axis of rotation is in a sagittal plane of said drum, wherein said sagittal plane is orthogonal to said base;

a detergent container receptacle;

a fabric softener container receptacle; and a heater, wherein said heater is engaged with a heated air conveyance, and wherein said sagittal plane is between said detergent container receptacle and at least a portion of said heater;

wherein said detergent container receptacle is further away from said sagittal plane than said fabric softener container receptacle, wherein said detergent container receptacle has a detergent container bottom wall and said fabric softener container receptacle has a fabric softener container receptacle bottom wall, and wherein said detergent container receptacle bottom wall is lower relative to said apparatus base than said fabric softener container receptacle bottom wall.

2. The laundry treatment apparatus according to claim 1, wherein said heater is elevationally higher than said axis of rotation when said laundry treatment apparatus is in operable position.

3. The laundry treatment apparatus according to claim 2, wherein said detergent container receptacle has a detergent container receptacle transverse width orthogonal to said sagittal plane, wherein said fabric softener container receptacle has fabric softener container receptacle transverse width orthogonal to said sagittal plane, wherein said detergent container receptacle transverse width is greater than said fabric softener container receptacle transverse width.

4. The laundry treatment apparatus according to claim 3, wherein said detergent container receptacle has a detergent container receptacle inlet port valve in fluid communication with said drum and wherein said fabric softener container receptacle has a fabric softener container receptacle inlet port valve in fluid communication with said drum.

5. The laundry treatment apparatus according to claim 4, wherein a detergent container is positioned within said detergent container receptacle and is in fluid communication with said detergent container receptacle inlet port valve, and wherein a fabric softener container is positioned within said fabric softener container receptacle and is in fluid communication with said fabric softener container receptacle inlet port valve.

6. The laundry treatment apparatus according to claim 5, wherein said fabric softener container receptacle projects further away from a transverse plane than said detergent container receptacle, wherein said transverse plane is perpendicular to said base and intersects a midpoint of said axis of rotation and is perpendicular to said sagittal plane.

7. The laundry treatment apparatus according to claim 1, wherein said detergent container receptacle has a detergent container receptacle transverse width orthogonal to said sagittal plane, wherein said fabric softener container receptacle has fabric softener container receptacle transverse width orthogonal to said sagittal plane, wherein said detergent container receptacle transverse width is greater than said fabric softener container receptacle transverse width.

8. The laundry treatment apparatus according to claim 1, wherein said fabric softener container receptacle projects further away from a transverse plane than said detergent container receptacle, wherein said transverse plane is perpendicular to said base and intersects a midpoint of said axis of rotation and is perpendicular to said sagittal plane.

9. A laundry treatment apparatus comprising:

an apparatus base upon which said laundry treatment apparatus rests;

a tub defining a portion of a fluid containment envelope, wherein said tub is above said apparatus base;

a drum positioned within the tub and rotatable relative to the tub about an axis of rotation that is within 20 degrees of horizontal relative to said base, wherein said axis of rotation is in a sagittal plane of said drum, wherein said sagittal plane is orthogonal to said apparatus base;

a detergent container receptacle;

a fabric softener container receptacle;

a perfume container receptacle;

wherein said detergent container receptacle is further away from said sagittal plane than said fabric softener container receptacle and said fabric softener container receptacle is further away from said sagittal plane than said perfume container receptacle;

wherein said detergent container receptacle, said fabric softener container receptacle, and said perfume container receptacle are elevationally higher than said axis of rotation when said laundry treatment apparatus is in operable position;

wherein said laundry treatment apparatus further comprises a heater in thermal communication with a heated air conveyance and said heated air conveyance is in fluid communication with said drum: wherein said sagittal plane is between said detergent container receptacle and at least a portion of said heater and said heater is elevationally higher than said axis of rotation when said laundry treatment apparatus is in operable position; or wherein said heater is elevationally lower than said axis of rotation when said laundry treatment apparatus is in operable position.

10. The laundry treatment apparatus according to claim 9, wherein said detergent container receptacle has a detergent container receptacle transverse width orthogonal to said sagittal plane, wherein said fabric softener container receptacle has fabric softener container receptacle transverse width orthogonal to said sagittal plane, wherein said perfume container receptacle has a perfume container receptacle transverse width orthogonal to said sagittal plane, wherein said detergent container receptacle transverse width is greater than said fabric softener container receptacle transverse width and said perfume container receptacle transverse width, wherein said fabric softener container receptacle transverse width differs from said perfume container receptacle transverse width.

11. The laundry treatment apparatus according to claim 10, wherein said detergent container receptacle has a detergent container receptacle bottom wall, wherein said fabric softener container receptacle has a fabric softener container receptacle bottom wall, wherein said perfume container receptacle has a perfume container receptacle bottom wall, wherein said detergent container receptacle bottom wall is lower relative to said apparatus base than said fabric softener container receptacle bottom wall and said fabric softener container receptacle bottom wall is lower relative to said apparatus base than said perfume container receptacle bottom wall.

12. The laundry treatment apparatus according to claim 11, wherein said drum has an inside diameter, wherein said detergent container receptacle has a detergent container receptacle center point, wherein said fabric softener container receptacle has a fabric softener container receptacle center point, wherein said perfume container receptacle has a perfume container receptacle center point, wherein each of said detergent container receptacle center point, said fabric softener container receptacle center point, and said perfume container receptacle center point are separated from said axis of rotation by less than 85% of said inside diameter.

13. The laundry treatment apparatus according to claim 12, wherein said detergent container receptacle has a detergent container receptacle inlet port valve in fluid communication with said drum, wherein said fabric softener container receptacle has a fabric softener container receptacle inlet port valve in fluid communication with said drum, and wherein said perfume container receptacle has a perfume container receptacle inlet port valve in fluid communication with said drum.

14. The laundry treatment apparatus according to claim 13, wherein a detergent container is positioned within said detergent container receptacle and is in fluid communication with said detergent container receptacle inlet port valve, wherein a fabric softener container is positioned within said fabric softener container receptacle and is in fluid communication with said fabric softener container receptacle inlet port valve, and wherein a perfume container is positioned with said perfume container receptacle and is in fluid communication with said perfume container receptacle inlet port valve, wherein each of said detergent container, said fabric softener container, and said perfume container comprises a flexible bag within a shell.

15. The laundry treatment apparatus according to claim 14, wherein said perfume container receptacle projects further away from a transverse plane than said fabric softener container receptacle and said fabric softener container receptacle projects further away from said transverse plane than said detergent container receptacle, wherein said transverse plane is perpendicular to said base and intersects a midpoint of said axis of rotation and is perpendicular to said sagittal plane.

16. The laundry treatment apparatus according to claim 9, wherein said detergent container receptacle has a detergent container receptacle bottom wall, wherein said fabric softener container receptacle has a fabric softener container receptacle bottom wall, wherein said perfume container receptacle has a perfume container receptacle bottom wall, wherein said detergent container receptacle bottom wall is lower relative to said apparatus base than said fabric softener container receptacle bottom wall and said fabric softener container receptacle bottom wall is lower relative to said apparatus base than said perfume container receptacle bottom wall.

17. A laundry treatment apparatus comprising:

a base upon which said laundry treatment apparatus rests;

a tub defining a portion of a fluid containment envelope, wherein said tub is above said base;

a drum positioned within the tub and rotatable relative to the tub about an axis of rotation that is within 20 degrees of horizontal, wherein said axis of rotation is in a sagittal plane of said drum, wherein said sagittal plane is orthogonal to said base;

a detergent container receptacle;

a fabric softener container receptacle; and a heater, wherein said heater is engaged with a heated air conveyance, and wherein said sagittal plane is between said detergent container receptacle and at least a portion of said heater;

wherein said detergent container receptacle is further away from said sagittal plane than said fabric softener container receptacle;

wherein said heater is elevationally higher than said axis of rotation when said laundry treatment apparatus is in operable position;

wherein said detergent container receptacle has a detergent container receptacle transverse width orthogonal to said sagittal plane;

wherein said fabric softener container receptacle has fabric softener container receptacle transverse width orthogonal to said sagittal plane;

wherein said detergent container receptacle transverse width is greater than said fabric softener container receptacle transverse width;

wherein said detergent container receptacle has a detergent container receptacle inlet port valve in fluid communication with said drum and wherein said fabric softener container receptacle has a fabric softener container receptacle inlet port valve in fluid communication with said drum;

wherein a detergent container is positioned within said detergent container receptacle and is in fluid communication with said detergent container receptacle inlet port valve;

wherein a fabric softener container is positioned within said fabric softener container receptacle and is in fluid communication with said fabric softener container receptacle inlet port valve;

wherein said fabric softener container receptacle projects further away from a transverse plane than said detergent container receptacle; and wherein said transverse plane is perpendicular to said base and intersects a midpoint of said axis of rotation and is perpendicular to said sagittal plane.

18. The laundry treatment apparatus according to claim 17, wherein said detergent container receptacle has a detergent container bottom wall and said fabric softener container receptacle has a fabric softener container receptacle bottom wall, and wherein said detergent container receptacle bottom wall is lower relative to said apparatus base than said fabric softener container receptacle bottom wall.

19. The laundry treatment apparatus according to claim 17, wherein said detergent container receptacle has a detergent container receptacle transverse width orthogonal to said sagittal plane, wherein said fabric softener container receptacle has fabric softener container receptacle transverse width orthogonal to said sagittal plane, and wherein said detergent container receptacle transverse width is greater than said fabric softener container receptacle transverse width.

20. The laundry treatment apparatus according to claim 17, wherein said fabric softener container receptacle projects further away from a transverse plane than said detergent container receptacle, and wherein said transverse plane is perpendicular to said base and intersects a midpoint of said axis of rotation and is perpendicular to said sagittal plane.

* * * * *